US005385097A

United States Patent [19]

Hruska et al.

[11] Patent Number: 5,385,097

[45] Date of Patent: Jan. 31, 1995

[54] ELECTROEXPLOSIVE DEVICE

[75] Inventors: Christopher D. Hruska, Blue Springs, Mo.; Todd M. McGinn, Olathe, Kans.; Wayne A. Smith, Liberty, Mo.

[73] Assignee: AT&T Corp., Murray Hill, N.J.

[21] Appl. No.: 92,648

[22] Filed: Jul. 16, 1993

[51] Int. Cl.[6] ..... F42C 19/12

[52] U.S. Cl. ..... 102/202.5; 102/202.1; 102/202.2

[58] Field of Search ..... 102/202.1, 202.2, 202.3, 102/202.4, 202.5, 202.7, 202.9, 472

[56] References Cited

U.S. PATENT DOCUMENTS

| | | | |
|---|---|---|---|
| 3,292,537 | 12/1966 | Gass, Jr. | 102/202.5 |
| 3,366,055 | 1/1968 | Hollander, Jr. . | |
| 4,819,560 | 4/1989 | Patz et al. . | |
| 4,967,665 | 11/1990 | Baginski | 102/202.2 |
| 5,085,146 | 2/1992 | Baginski | 102/202.5 |
| 5,285,727 | 2/1994 | Reams, Jr. et al. | 102/202.5 |

*Primary Examiner*—Harold J. Tudor

*Attorney, Agent, or Firm*—Lester H. Birnbaum

[57] ABSTRACT

Disclosed is an electroexplosive device including a semiconductor igniter chip with improved crack detection features and which fires in a known location. The chip includes diffused regions so that cracks formed therethrough will result in high leakage currents which are easily detected.

5 Claims, 5 Drawing Sheets

ELECTROEXPLOSIVE DEVICE

BACKGROUND OF THE INVENTION

This invention relates to electroexplosive devices.

Electroexplosive devices are used in ordinance systems to ignite an explosive or pyrotechnic mixture. The devices typically comprise a semiconductor chip in contact with the explosive mixture. (See, for example, U.S. Pat. No. 3,366,055 issued to Hollander, Jr.) When a firing voltage is applied to the chip, the temperature rise generated is sufficient to ignite the mixture. Two important characteristics of the chips are that they exhibit high reliability in firing and that they prevent stray RF fields and induced arcing from igniting the mixture.

One problem associated with such devices is that, if cracks develop the chips, RF immunity is decreased and misfires could occur. Such cracks are not easily detected since many times the I-V curves of the chips would remain the same even after cracks developed. Thus, it is desirable to provide chips with improved crack detection.

In addition to crack detection, it is desirable to be able to fire the chip in a small predetermined area in order that the firing energy is discharged in close proximity to the mixture.

U.S. Pat. No. 5,085,146 issued to Baginski shows an electroexplosive device using a semiconductor chip with p-type dopants diffused into both major surfaces. In one embodiment (FIG. 3), the p-type dopants are formed at the center the chip and extend in "corridors" out to and including the edge of the chip. In a further embodiment (FIGS. 4 and 5), the p-type region on one surface is isolated at the center of the chip. Schottky barrier junctions are also disclosed. It is recognized that the leakage currents through the p-n junction can be used to test the chip.

U.S. Pat. No. 4,8 19,560, issued to Patz et al., also shows a chip for an igniter which includes a diffused diode portion, or a transistor portion.

SUMMARY OF THE INVENTIONS

The invention is a device including an explosive mixture and a semiconductor igniter chip adjacent to the mixture. The chip includes a semiconductor substrate of a first conductivity type having a pair of major surfaces, an ignition region at one of the surfaces in an area adjacent to the mixture, and an edge region. A first region of opposite conductivity type is formed in one major surface and extends a substantial lateral distance across the surface. The lateral distance is substantially larger than the ignition region. A dielectric layer is formed over the surface to cover at least a major portion of the region of opposite conductivity type. The dielectric layer includes an opening therein exposing the semiconductor surface at the ignition region of the chip. A metal layer is firmed over the dielectric layer so as to make electrical contact to the ignition region of the chip.

BRIEF DESCRIPTION OF THE DRAWING

These and other features of the invention are delineated in detail in the following description. In the drawing.

It will be appreciated that, for purposes of illustration, these figures are not necessarily drawn to scale.

DETAILED DESCRIPTION

Figure 1:
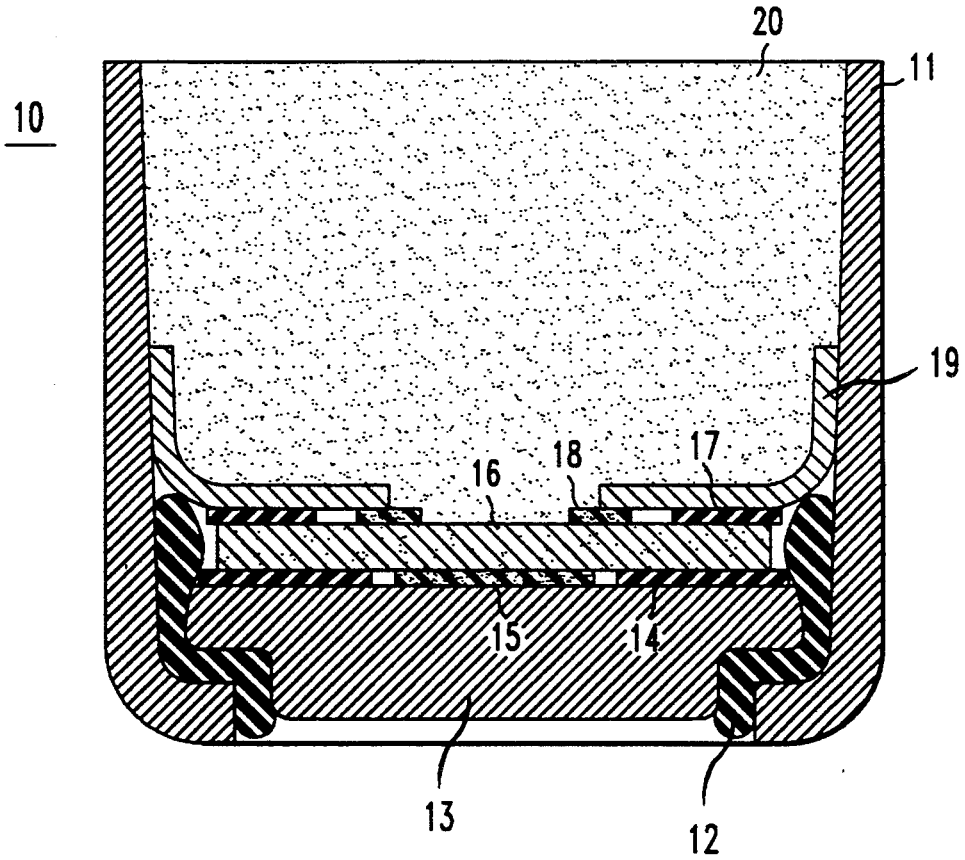
FIG. 1 is a cross-sectional view of an assembly including an electroexplosive device in accordance with an embodiment of the invention.

FIG. 1 illustrates an assembly 10 which can be used in accordance with an embodiment of the invention for igniting an explosive mixture. The elements of the assembly are held within an outer cup 11 which is typically made of a metal such as brass. The cup is typically cylindrical with a constricted opening at the bottom as shown.

Positioned within the constricted opening of the outer cup 11 and along its side walls is a cylindrical washer 12 made of an insulating material such as Valox® (GE Trademark). The washer 12 also has a constricted opening at the bottom following the contours of the opening in the outer cup 11 and has a grooved inner surface. Mounted within one of the grooves of the washer 12 is a primer button 13, which is typically made of brass. The bottom surface of the button is exposed at the constricted openings of the cup 11 and washer 12. The top surface of the button 13 is essentially flat and includes an annular washer 14 made of an insulating material such as KAPTON® (DuPont Trademark). The center hole of the washer typically has a diameter of approximately 2500 microns. Deposited within the hole is a layer 15 of conductive material, which is usually conductive epoxy.

Mounted on top of the washer 14 and epoxy 15 is a semiconductor igniter chip 16 which will be described in more detail below. On the opposite major surface of the chip is another annular washer 17 which can also be made of KAPTON®. Within the hole in washer 17 is a further annular washer 18 which is made of a conductive material such as conductive epoxy. The hole in the annular washer 18 typically has a diameter in the range 500–2500 microns. Positioned on top of the washers 17 and 18 is an inner cup 19 which is cylindrical and has a hole at the bottom at least as large as the hole in washer 18. The inner cup can also be made of brass.

An explosive mixture 20 such as gunpowder fills the remainder of the outer cup 11.

Because of the specific requirements of this embodiment, the chip is exposed to large compressive forces when the explosive mixture 20 is pressed into place on top of the semiconductor chip 16. This leads to the possibility of cracked semiconductor chips which results in reduced RF immunity and decreased reliability. Further, the firing energy must be confined to a small location that is in contact with the explosive mixture for the device to operate successfully.

In operation, the assembly of FIG. 1 is loaded into a bullet casing (not shown) so that the outer cup 11 makes physical and electrical contact with the casing. A voltage (typically 5–500 volts) is applied between the bottom surface of the button 13 and the casing. Current passes through the button, the epoxy dot 15, and the semiconductor chip 16. As discussed in more detail below, the electrical contact to the top of the chip should be extremely small (of the order of 1–40 microns in diameter) so that the current is concentrated enough to generate a large temperature rise. The temperature should be sufficient to ignite the explosive mixture. The location of the small contact determines the location of the initial ignition.

While the above description is directed to firing of bullets, it will be appreciated that the present invention is applicable to other electroexplosive devices, such as blasting caps.

In the usual method of fabricating the assembly of FIG. 1, the semiconductor chip 16 with the conductive epoxy 18 and washer 17 deposited on one surface is attached to inner cup 19 to form a subassembly. The chip could then be tested as pan of this subassembly, if desired, prior to completion of the entire assembly to determine if any cracks have developed in the chip which might cause misfiring or reduce RF shielding properties. Testing is preferably performed by applying a forward bias to the chip and then measuring the leakage current at some voltage below the breakdown voltage for the device (typically at 90 percent of the breakdown voltage).

In accordance with a main feature of the invention, the chips were designed so that leakage currents would increase substantially when a crack appeared, thereby making it easy to determine if a chip was faulty prior to and after the fabrication of the assembly. It is desirable that the crack detection region extend across the area of the chip surface exposed to the mixture, 20, and include at least a portion of the area under the washer 17. This placement of the crack detection means ensures that no defect in the chip area exposed to the mixture 20 will cause accidental firing, and no crack in the chip under the conductive washer 18, or under inner cup 19 in a portion not protected by the insulating washer 17, will cause conduction away from the mixture and thereby result in no firing.

Figure 2:
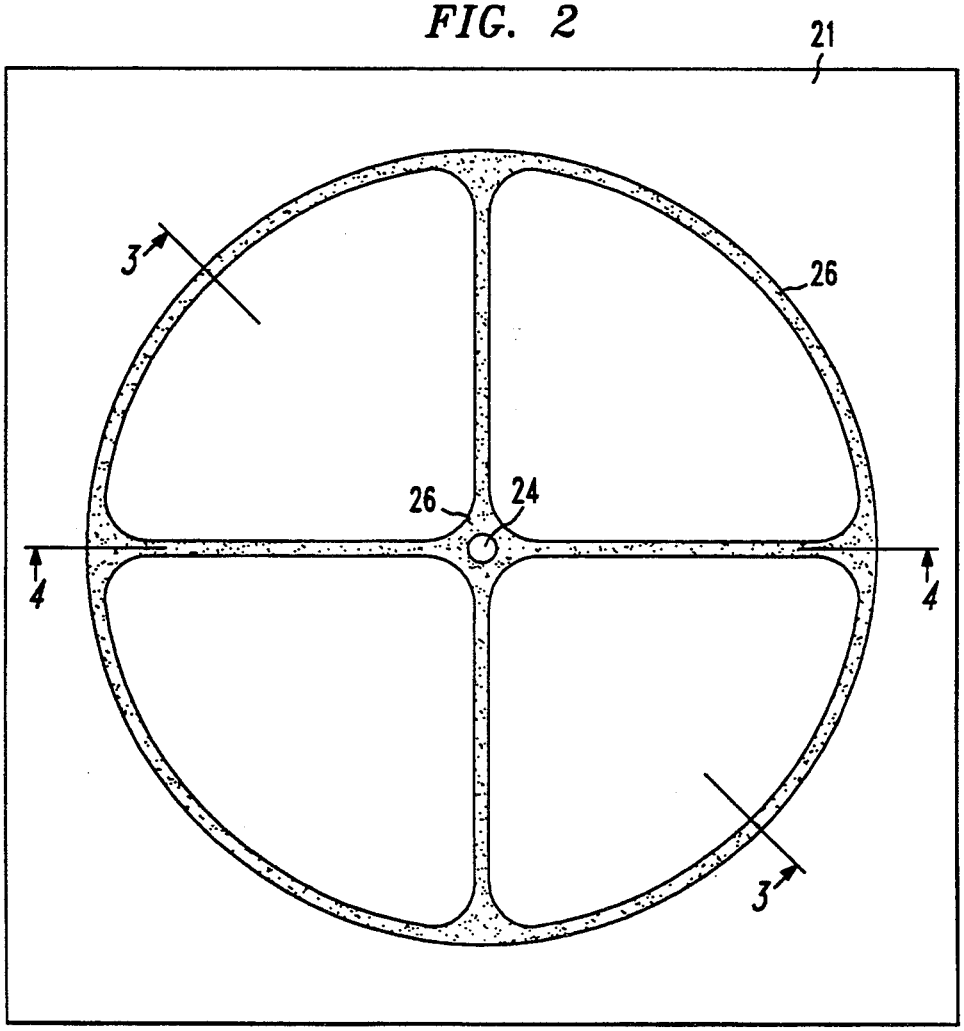
FIG. 2 is a plan view of a portion of a semiconductor chip in accordance with an embodiment of the invention.
Figure 3:
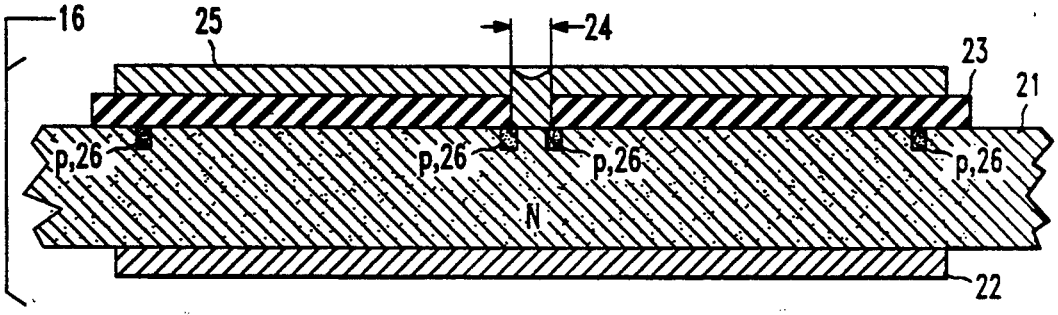
FIG. 3 is a cross-sectional view of an essentially complete semiconductor chip along the line 3—3 of FIG. 2.
Figure 4:
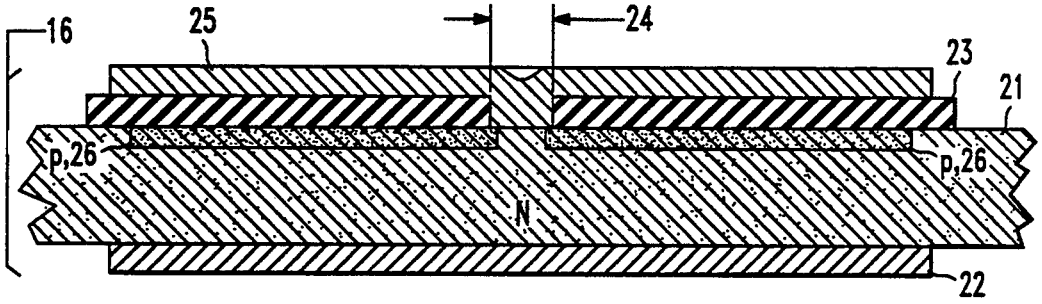
FIG. 4 is a cross-sectional view of an essentially complete semiconductor chip along the line 4—4 of FIG. 2.

FIGS. 2–4 illustrate one form of a chip, 16, with improved crack detection. As best seen in FIGS. 3 and 4, the chip includes a semiconductor substrate 21, usually silicon, which has a first conductivity type, in this example n-type. The thickness of the substrate is typically 500–660 microns. Formed on an arbitrary sized area or on essentially the entire bottom surface of the substrate is a metal layer 22 which forms a Schottky contact with the semiconductor surface. The metal is typically platinum with a thickness of approximately 2000 angstroms.

On the opposite major surface of the substrate 21, there is formed a dielectric layer 23 such as silicon dioxide. The dielectric layer is formed over essentially the entire area of the surface but includes an aperture therein which exposes a small ignition portion (24) of the substrate. The dielectric layer has a thickness within the range 0.6–1.4 microns. The location of this aperture determines the firing location of this device and should be positioned in an area exposed to the explosive mixture. In this example, the aperture is centrally located. The ignition portion 24 needs to be small enough to concentrate current through the chip and thereby generate sufficient heat to ignite the explosive mixture (20 of FIG. 1 ). Consequently, the ignition portion 24 is preferably in the range 1–40 microns in diameter. A layer 25 of metal is formed over an arbitrary sized area of the dielectric layer 23 and makes contact with the ignition portion 24 of the substrate so as to form a Schottky contact at that portion. Again, the metal layer can be aluminum and is typically 4000–6000 microns in thickness.

In accordance with a feature of the invention, a region 26 of conductivity type, in this case p-type, opposite to the substrate is formed in the top surface. This region can be formed by standard diffusion or ion implantation techniques using standard photolithography. The p-type region 26 typically extends approximately 1–4 microns into the substrate from the top surface.

FIG. 2 is a plan view of the top surface of the chip with the dielectric layer 23 and contact metal 25 removed in order to better illustrate the pattern of the p-type region 26. It will be noted that the region has the geometry of a wheel with a rim portion (guard ring) essentially concentric with the ignition portion 24 and a plurality of spokes (in this case four) radiating from the rim portion to the ignition portion 24. It will be noted, however, that the ignition portion 24 retains the conductivity of the substrate so that the Schottky contact is formed therewith. It will also be realized that the metal layer 25 contacts the substrate only in the ignition portion 24 and also makes contact only with a small portion of the p-type region 26, i.e., approximately 2 microns. The long, narrow, p-type "spokes" allow a resistive electrical contact to the entire p-type region 26 for crack detection. Thus, the p-type region 26 is used essentially only for crack detection, while the firing of the chip is limited to the area of the chip exposed by layer 23.

Figure 7:
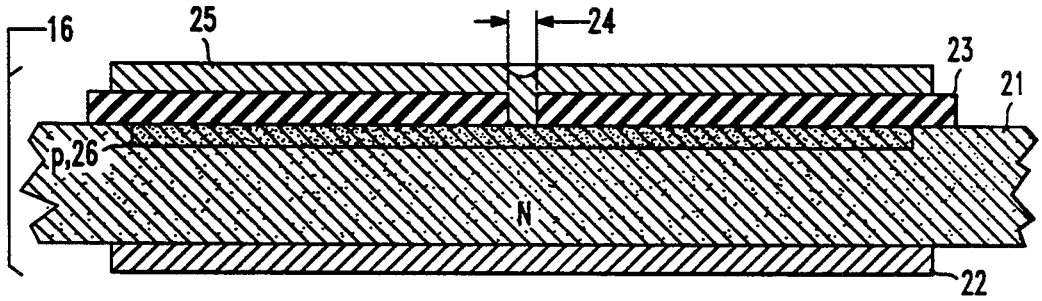
FIG. 7 is a cross-sectional view of an essentially complete chip along the line 7—7 of FIG. 5.
Figure 5:
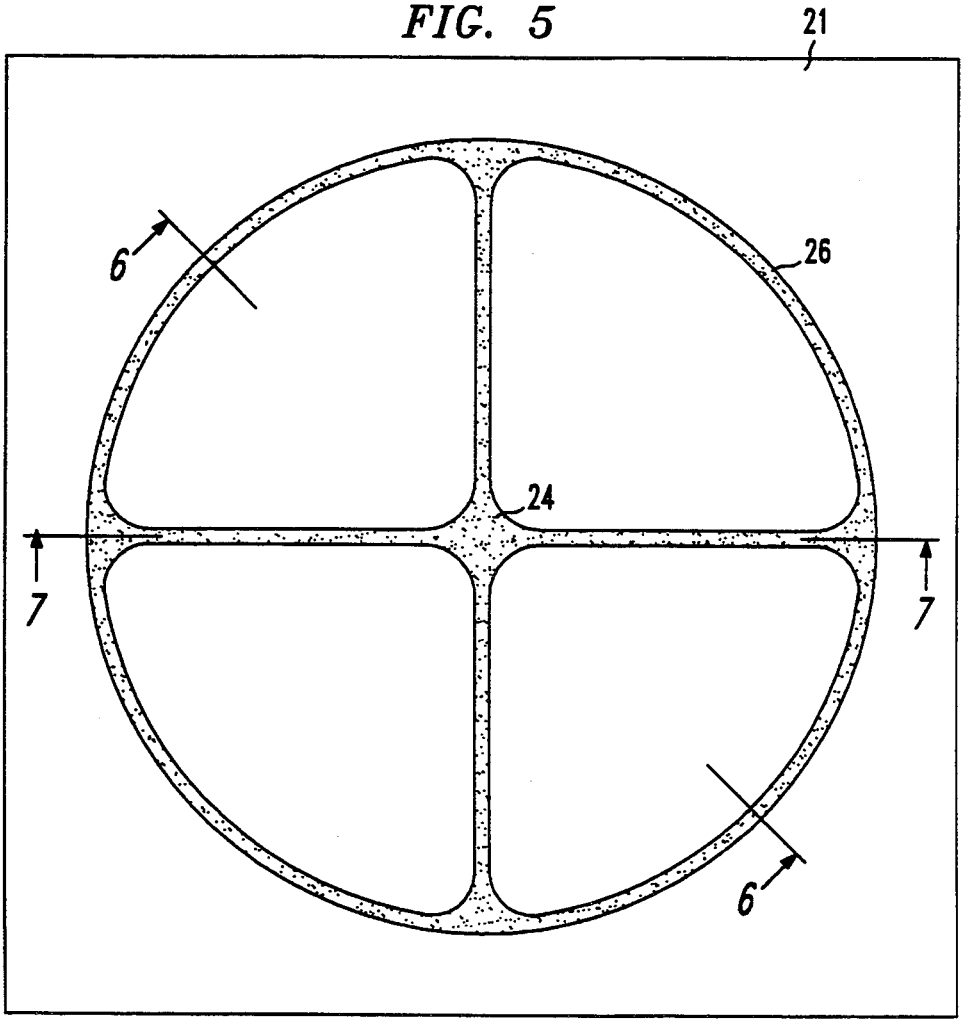
FIG. 5 is a plan view of a portion of a semiconductor chip in accordance with a further embodiment of the invention.
Figure 6:
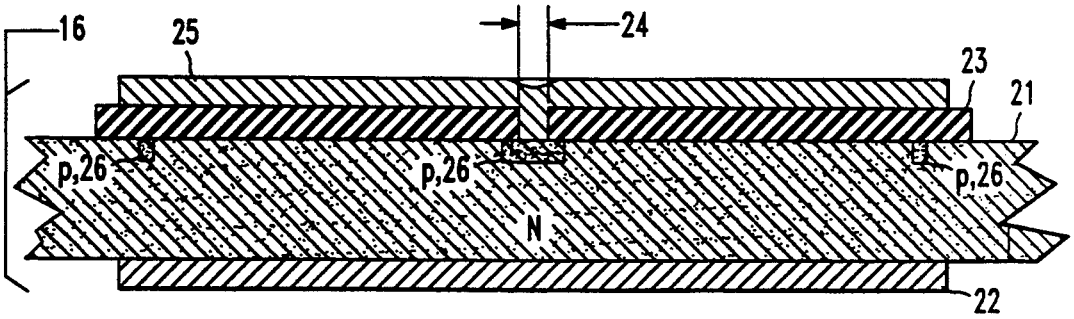
FIG. 6 is a cross-sectional view of an essentially complete chip along the line 6—6 of FIG. 5.

In testing for cracks, the chip is typically forward biased, and the leakage current is determined at 90 percent of the forward breakdown voltage. Leakage without cracks was typically less than 1 μamp. However, when cracks were introduced in the semiconductor, in most cases, leakage current increased to at least 10 μamps FIGS. 5–7 illustrate an alternative embodiment to that shown in FIGS. 2–4, with similar elements beings similarly numbered. The major difference here is that the p-type diffused pattern 26 also completely covers the ignition region 24 of the chip. Thus, a diode rather than a Schottky contact is formed on the top surface of the chip. Firing is still limited to the ignition portion since the metal layer 25 is still insulated from the semiconductor outside this portion by the insulating layer 23. This version may be simpler to process since there is no critical alignment needed between the p-type region and the top contact. Crack detection characteristics are expected to be similar to the embodiment of FIGS. 2–4.

Figure 8:
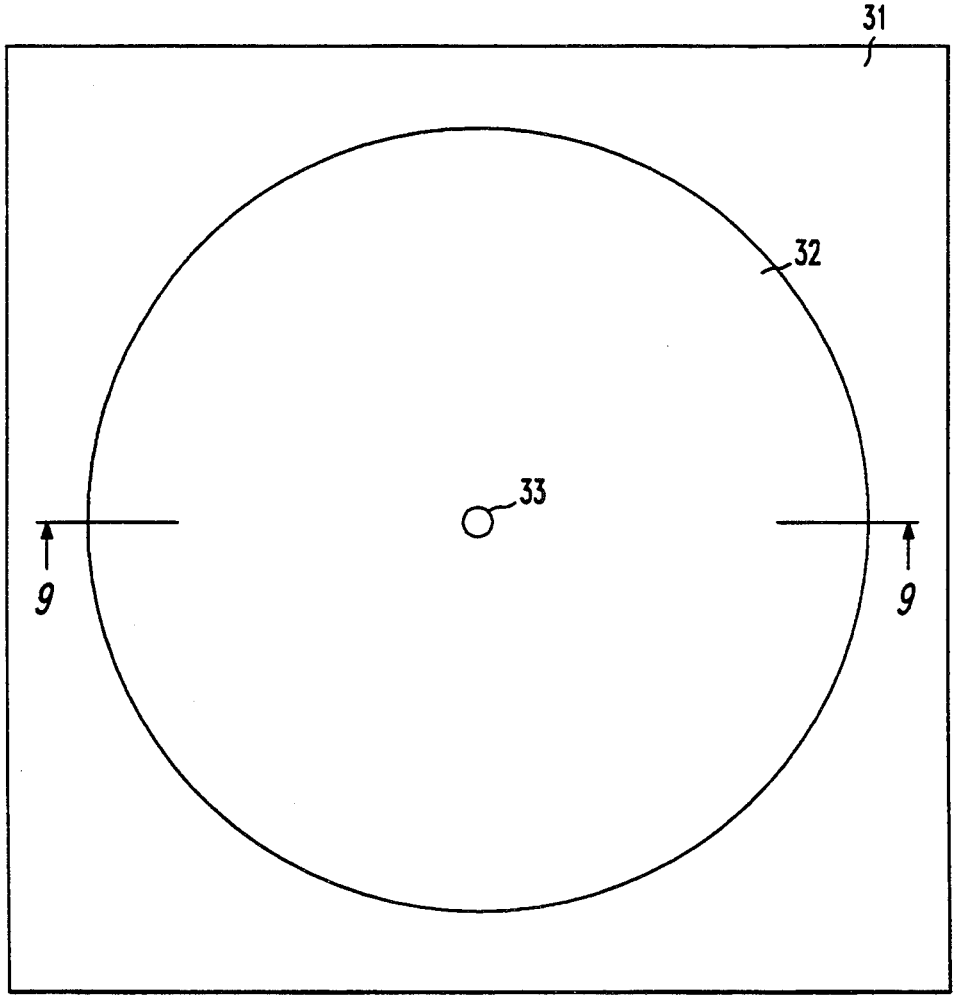
FIG. 8 is a plan view of a portion of a semiconductor chip in accordance with a still further embodiment of the invention.
Figure 9:
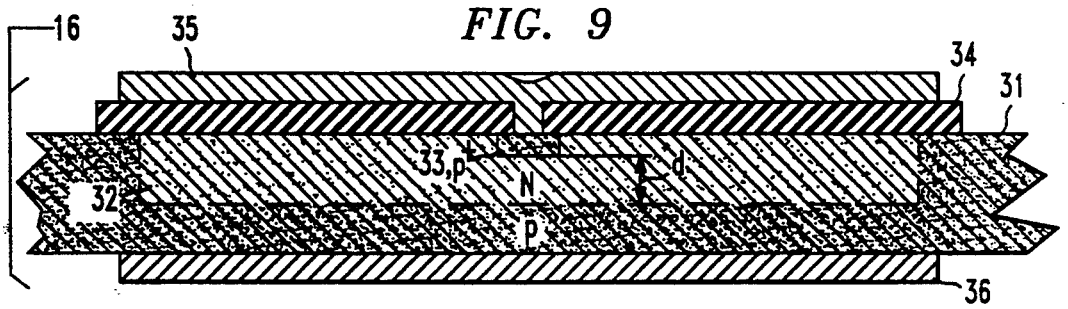
FIG. 9 is a cross-sectional view of an essentially complete chip along the line 9—9 of FIG. 8.

FIGS. 8 and 9 illustrate a still further embodiment of the invention. (Again, the plan view of FIG. 8 shows only the pattern of regions in the top surface of the semiconductor.) In this example, the semiconductor substrate 31 comprises silicon which has a p-type conductivity. For example, the substrate can be doped with boron to achieve a resistivity of 10–20 ohms—cm. Formed in the top surface, for example, by standard diffusion or ion implementation techniques, is a region 32 of n-type conductivity. This region typically has a sheet resistance of 800–1000 ohms per square and can be formed by using phosphorus as a dopant. The depth of the n-type region is typically at least which has the same conductivity type as the substrate but higher impurity concentration 6 microns. Formed within the n-type region is a region 33 of p+ conductivity type. This region 33 can be formed by diffusion of boron dopants into the top surface to a depth of approximately 1 micron to establish a sheet resistance of approximately 10 ohms per square. The region 33 is formed at the desired location of ignition, in this case the central portion of the chip. For reasons previously discussed, the diameter of region 33 is preferably less than 40 microns.

An insulating layer 34, in this example silicon dioxide, is formed over essentially the entire top surface of the substrate 31, but includes a small aperture to expose the region 33. The insulating layer is typically 1 micron thick. Formed on an arbitrary sized area of the layer 34 is a metal layer 35 comprising aluminum-chrome-gold which makes electrical contact to the exposed p+ region 33. The metal layer 35 typically has a thickness of 5000 Å and, in this example, has a diameter of approximately 3500 microns. Foraged on an arbitrary sized area or essentially the entire bottom surface of the substrate 31 is another metal layer, 36, which in this example comprises platinum with a thickness of approximately 2000 angstroms.

It will be noted that the structure of FIGS. 8 and 9 resembles a double-diffused, p-n-p, transistor. However, no contact is formed to the n-type region 32 since that region is used only for crack detection and not to provide any transistor action. For the same reason, the difference,d, between the depth of the p+ region 33 and the depth of the n-type region 32 needs to be large to minimize any action and to, produce the right breakdown characteristics as described below. Preferably, the value of d is at least 3 μm.

The structure of FIGS. 8 and 9 forms a diode on the top surface and an ohmic contact on the bottom surface. Since only the top surface needs to be polished, processing is simplified over the previously described structures where a Schottky contact is needed on the bottom surface. The structure of FIGS. 8 and 9 also possesses a high reverse breakdown voltage (preferably at least 200 volts). Thus, by reverse-biasing the diode formed by the lower p-n junction, leakage current can be monitored to detect cracks. In typical samples, the leakage current increased by at least an order of magnitude when cracks were formed in the semiconductor substrate.

In order to provide crack detection, it is desirable that the region 32 cover at least 25 percent of the surface of the chip.

In an alternative embodiment, the diffused region 32 would be replaced by an epitaxial layer.

In general, chips used in electroexplosive devices will be square with sides ranging from 500 microns to 12,500 microns. The lateral distance of the crack detection region (26 of FIGS. 2 and 5 or 32 of FIG. 8) will generally be in the range 350–12,480 microns with the ignition region (33 or 24) being no greater than 25 percent of that lateral distance.

Various additional modifications will become apparent to those skilled in the art. All such variations which basically rely on the teachings through which the invention has advanced the art are properly considered within the scope of the invention.

We claim:

1. A device including an explosive mixture and a semiconductor igniter chip adjacent to said mixture, said chip comprising:

a semiconductor substrate of a first conductivity type, and having a pair of major surfaces, an ignition region at one of said surfaces in an area adjacent to the mixture, and an edge region;

a first region of opposite conductivity type formed in the major surface adjacent to the mixture and extending a substantial lateral distance across the surface, the lateral disgrace being substantially larger than the ignition region;

a dielectric layer formed over said major surface adjacent to the mixture so as to cover completely the region of opposite conductivity type, the dielectric layer including an opening therein exposing the semiconductor surface at the ignition region of the chip; and a single metal formed over the dielectric layer and said opening so as to make electrical contact to the ignition region of the chip, the dielectric layer covering the first region to prevent contact therewith by the metal layer.

2. The device according to claim 1 further comprising a second region of the same conductivity type as the substrate, but higher impurity concentration, formed within the first region in the ignition region of the chip such that only said second region is exposed by the opening in the dielectric.

3. The device according to claim 2 wherein the difference in depth of the first and second regions is at least 3 μm

4. The device according to claim 3 wherein a metal layer is formed on the opposite major surface in order to establish an ohmic contact thereto.

5. The device according to claim 1 wherein the opening in the dielectric layer is less than 40 microns in diameter.

* * * * *